US007473120B2

(12) United States Patent
Zhang et al.

(10) Patent No.: US 7,473,120 B2
(45) Date of Patent: Jan. 6, 2009

(54) ZIF SOCKET CONNECTOR WITH POP-UP PICK-UP CAP WHEN COVER IS MOVED TO OPEN POSITION

(75) Inventors: Jie-Feng Zhang, ShenZhen (CN); Qi-Jin Yi, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/894,955

(22) Filed: Aug. 22, 2007

(65) Prior Publication Data

US 2008/0050959 A1 Feb. 28, 2008

(30) Foreign Application Priority Data

Aug. 22, 2006 (CN) ..... 2006 2 0075642 U

(51) Int. Cl.
*H01R 4/50* (2006.01)

(52) U.S. Cl. ..... 439/342; 439/41; 439/940

(58) Field of Classification Search ..... 439/342, 439/41, 940, 135, 521
See application file for complete search history.

(56) References Cited

U.S. PATENT DOCUMENTS 6,626,691 B2 * 9/2003 Yu ..... 439/342

* cited by examiner

*Primary Examiner*—Tho D Ta
*Assistant Examiner*—Travis Chambers
(74) *Attorney, Agent, or Firm*—Wei Te Chung

(57) ABSTRACT

A ZIF socket connector comprises a base defining a plurality of passageway therein and each received therein a contact terminal therein. The base defines a first and second end. A cover is moveably attached to the base in a direction from the first end to the second end of the base, and defines a plurality of guiding holes each aligned with the passageway. An actuating lever with a cam portion is disposed in the first end of the housing, and is interengaged with the cover so as to move the cover on the base along the direction. The cover includes a top surface. A pick up cap is disposed on the top surface of the cover, and includes a first end disposed on the top surface of the cover, and a second end interlocked to a sidewall of the base at the second end. The first end of the pickup cap is released when the cover is moved away from the second end of the base.

8 Claims, 3 Drawing Sheets

ZIF SOCKET CONNECTOR WITH POP-UP PICK-UP CAP WHEN COVER IS MOVED TO OPEN POSITION

BACKGROUND OF THE INVENTION

1. Field of the Invention

The present invention relates to a ZIF socket connector, and more particularly, to a ZIF socket connector provided with pop-up pickup cap when the cover is moved to an opened position.

2. Description of the Prior Art

U.S. Pat. No. 5,833,483 issued to Lai et al on Nov. 10, 1998 discloses a so-called ZIF socket connector. It generally includes a base 303, a cover 100 moveably mounted onto the base 303, and an actuating device 200 arranged on the base 303 and interlocked with the cover 100 so as to drive the cover 100 to move along the base 303.

It was well recognized that a pickup cap is necessary for this ZIF socket connector for easy pick-and-place operation during the surface-mounted. Generally, the pickup cap can be a variety of configuration, from a plastic tap attached to a top surface, to a plastic cap snapped/secured to sides of the cover. The reason for attaching the pickup cap on sides of the cover is that both ends of the pickup cap will be interlocked to sides of the cover. The difficulty for attaching the pickup cap another way, i.e. see line 3-3 of FIG. 1 of Lai '483 patent, is that the first end of the pickup cap has to be interlocked with the base, while the other end of the pickup cap has to go to the top surface. It has been a while that industry does not appreciate this arrangement.

No matter when the pickup cap attached, it has to be removed before a CPU package can be disposed on the cover, and make an electrical connection with the contact terminals within the base. For the tap, it has to be peeled off from the cover. For the pickup cap snapped to sides of the cover, it has to be removed by fingers. Recently, there is a call from the system manufacturer to introduce a pickup cap which can be automatically removed by the operation of the lever as in some other type of the socket connector, this arrangement has been arranged.

SUMMARY OF THE INVENTION

It is therefore an object of the present invention to provide a ZIF socket connector in which a pickup mounted thereon can be easily popped out when the cover is moved to an opened position.

In order to achieve to the object set forth, a ZIF socket connector made in accordance with the present invention comprises a base defining a plurality of passageway therein and each received therein a contact terminal therein. The base defines a first and second end. A cover is moveably attached to the base in a direction from the first end to the second end of the base, and defines a plurality of guiding holes each aligned with the passageway. An actuating lever with a cam portion is disposed in the first end of the housing, and is interengaged with the cover so as to move the cover on the base along the direction. The cover includes a top surface. A pick up cap is disposed on the top surface of the cover, and includes a first end disposed on the top surface of the cover, and a second end interlocked to a sidewall of the base at the second end. The first end of the pickup cap is released when the cover is moved away from the second end of the base.

DETAILED DESCRIPTION OF THE PREFERRED EMBODIMENT OF THE INVENTION

Reference will now be made to the drawings to describe the present invention in detail.

Figure 1:
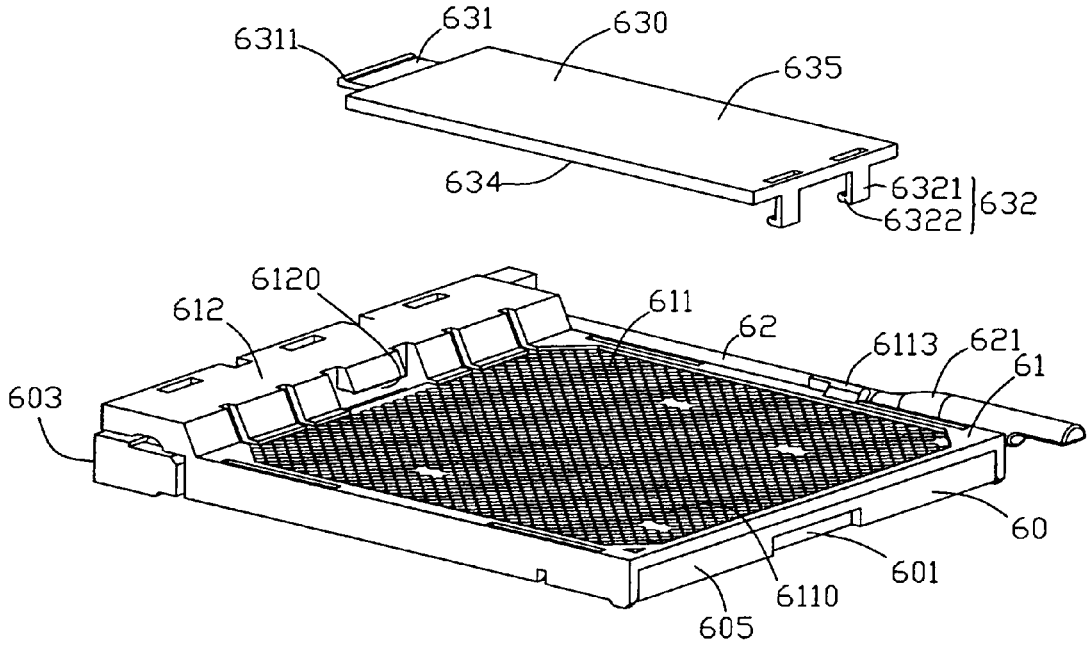
FIG. 1 is exploded, isometric view of a ZIF socket connector of the present invention.
Figure 2:
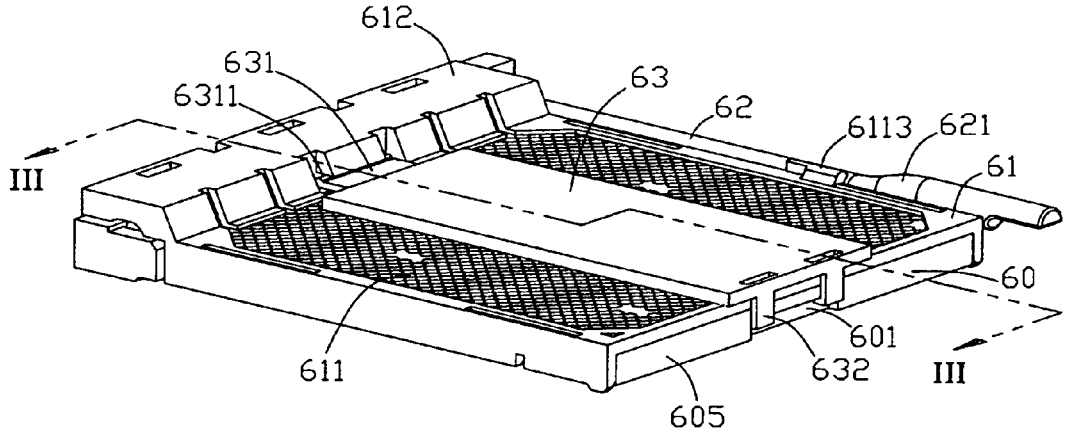
FIG. 2 is an assembled view of FIG. 1.
Figure 3:
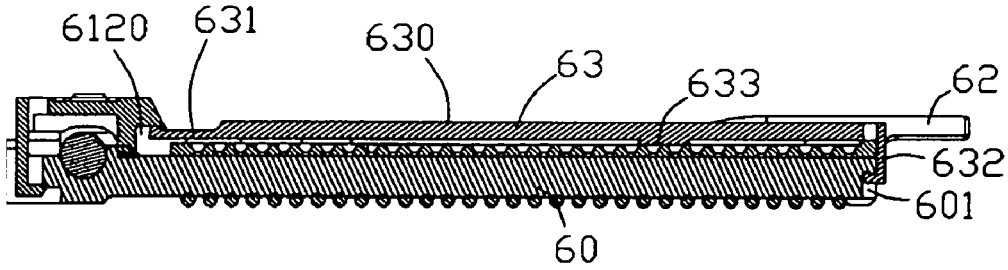
FIG. 3 is a cross-section view taken along line III-III of FIG. 2.

Reference to FIGS. 1 to 3, a ZIF socket connector 6 in accordance with the present invention is used in a known way to connect an IC package (not shown) to a printed circuit board (not shown) on which the ZIF socket 6 is mounted. The ZIF socket connector 6 comprises a dielectric base 60, a cover 61 slidably mounted on the dielectric base 60, a plurality of contacts (not shown) received in the dielectric base 60 for electrically connecting corresponding pins of the IC package with the printed circuit board, and an actuating element 62 assembled to and fastening together both the dielectric base 60 and the cover 61.

The dielectric base 60 is configured as a rectangular shape and defines a plurality of contact receiving passageways (not shown) for accommodating corresponding contacts therein. The contacts have circuit board engaging section (not shown) for mating engagement with circuit traces on a circuit board. The contact receiving passageways are some what elongated, and each of the contacts has a deflectable contact arm disposed near one end of its respective contact-receiving passageway. The dielectric base 60 defines a first end 603 and a second end 605 in a direction the cover 61 slides on the dielectric base 60. The sidewall of the second end 605 of the dielectric base 60 defines a groove 601 at the sidewall.

The cover 61 is movable on the dielectric base 60 over a relatively small distance between open and closed positions and comprises a main body 611 and a head section 612 extending forwardly from a front end of the main body 611. A plurality of through-holes 6110 is defined through the main body 611 of the cover 61. When the cover 61 is in the open position, the through-holes 6110 are aligned with respective contact receiving passageways, whereby the pins of the IC package enter the contact receiving passageways of the base 60 against virtually no resistance. When the cover 61 is moved to the closed position, the pins of the IC package are moved to resiliently deflect their respective contact arms, thereby establishing electrical connection between the IC package and the socket connect. The top face (not shown) of head section 612 is higher than that of the main portion 611. The head section 612 defines a slot 6120 adjacent to the first end 603 of the base 60.

An actuating element such as a lever 62 has an "L" type shape and comprises a connecting portion (not shown) between the base 60 and the cover 61 adjacent to the first end 603 of the base 60 and an operating portion 621 angled to the connecting portion. The connecting portion defines a cam portion (not shown) for operating the cover 61 sliding on the base 60. The lever 62 has open and closed positions corresponding to the open and closed positions of the cover 61. When open, the lever 62 stands upright in a vertical orientation with respect to the socket connector 6, and when closed, the lever 62 resides horizontally along the socket connector 6.

The cover 61 has a latch 6113 in the form of a projecting tab for holding the lever 62, and thus the cover 61, in the closed position. The latch 6113 can be overcome by applying a sufficient force to resiliently deflect the lever 62 around the latch 6113.

The pickup cap 63 has an approximately rectangular planar body 635 and a tongue portion 631 extending from the planar body 635 toward to the first end 603 of the base 60. The planar body 635 has a smooth top surface 630 capable of being handled by a device (not shown) and a bottom surface 634 opposite to the top surface 630. The top surface 630 of the pickup cap 63 covers the main body 611 of the cover 61 partially. The tongue portion 631 is moveably attached to the slot 6120 of the head section 612 of the cover 61 and defines a plurality of ribs 6311 interferingly engagement with the slots 6120 of the head section 612. The end of the pickup cap 63 opposite to the tongue portion 631 includes a plurality of hooks 632 extending downwardly from the bottom surface 634 of the pickup cap 63. The hooks 632 each has an "L" shape and comprises a base portion 6321 extending downwardly from the bottom surface 632 of the pickup cap 63 and a clasp 6322 angled to the base portion 6321, the clasp portion 6322 is moveably attached to the groove 601 of the base 60. The bottom surface 632 of the pickup cap 63 defines a plurality of locating protrusions 633 and the locating protrusions 633 abut against the top surface of the cover 61 for adding the strength of the pickup cap 63 and avoid the deformation of the pickup cap 63.

In assembly and use, the actuating element 62 is first assembled in the first end 603 of the base 60, secondly, the cover 61 is assembled on the base 60, and then the pickup cap 63 is moveably attached to the cover 61 and the base 62, now, the tongue portion 631 of the pickup cap 63 is inserted to the slot 6120 of the cover 61 and the hook 632 of the pickup cap 63 is attached to the groove 601 of the sidewall of the second end 605 of the base 60, the lever 62 resides horizontally along the socket connector 6 and is in a closed position, of course, the cover 61 is also in a closed position, the ZIF socket connector 6 can be moved to a predetermined position by the pickup cap 53. When the lever 62 is release to the open position, that is the lever 62 is moved to a vertical orientation with respect to the socket connector 6 and the cover 61 is moved away from the second end 605 of the base 60, the pickup cap 63 can be easily popped out from the ZIF socket connector 6.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. A ZIF socket connector, comprising:

a base defining a plurality of passageway therein and each received therein a contact terminal therein, the base defining a first and second end;

a cover moveably attached to the base in a direction from the first end to the second end of the base, and defining a plurality of guiding holes each aligned with the passageway;

an actuating element with a cam portion disposed in the first end of the base, and interengaging with the cover so as to move the cover on the base along the direction, the cover including a top surface; and a pick up cap disposed on the top surface of the cover, and including a first end disposed on the top surface of the cover adjacent to the first end of the base, and a second end interlocked to a sidewall of the base at the second end; wherein the first end of the pickup cap is temporarily held by a slot defined in an embossed area of the cover; wherein the first end of the pickup cap is released when the cover is moved away from the second end of the base.

2. The ZIF socket connector as recited in claim 1, wherein the pickup cap defines a smooth flat top surface and a bottom surface opposite to the top surface.

3. The ZIF socket connector as recited in claim 2, wherein the bottom surface of the pickup cap defines a plurality of locating protrusions.

4. The ZIF socket connector as recited in claim 1, wherein the actuating element is a lever.

5. A socket connector comprising:

an insulative base;

an insulative cover mounted upon and moveable relative to the base along a front-to-back direction;

a pick up cap mounted upon the cover and defining one engaging section engaged with the cover; wherein when the cover is moved relative to the base along a lengthwise direction parallel to said front-to-back direction, said engaging section is disengaged from the cover; wherein the cover is actuated to move by a lever rotated about a horizontal axis, and said pick up cap is spaced from said lever.

6. The socket connector as claimed in claim 5, wherein the pick up cap is still seated upon the cover after the engaging section is disengaged from the cover.

7. The socket connector as claimed in claim 5, wherein said pick up cap is not moved when said cover is moved along said lengthwise direction.

8. A method of removing a pick up cap from a socket connector, comprising steps of:

providing a socket including an insulative base and an insulative cover which is mounted upon and moveable relative to the base along a front-to-back direction;

providing a level for actuating the cover to move relative to the base along a lengthwise direction parallel to said front-to-back direction; and mounting a pick up cap upon the cover to have an engagement section of the pick up cap is engaged with the cover;

rotating the lever to force the cover to move relative to the base along said lengthwise direction so as to release the engagement section from the cover due to the pick up cap is not moved.

* * * * *